US006318727B1

(12) United States Patent
Hada

(10) Patent No.: US 6,318,727 B1
(45) Date of Patent: Nov. 20, 2001

(54) APPARATUS FOR MAINTAINING A FLUID SEAL WITH A MOVING SUBSTRATE

(75) Inventor: Frank Stephen Hada, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/435,601

(22) Filed: Nov. 5, 1999

(51) Int. Cl.[7] ..... F16J 15/16
(52) U.S. Cl. ..... 277/345; 277/500; 277/906
(58) Field of Search ..... 277/345, 500, 277/578, 579, 906

(56) References Cited

U.S. PATENT DOCUMENTS

| | | |
|---|---|---|
| 1,297,192 | 3/1919 | Le Roy et al. . |
| 1,549,338 | 8/1925 | Tompkins . |
| 1,718,573 | 6/1929 | Millspaugh . |
| 1,843,656 | 2/1932 | Tompkins et al. . |
| 2,091,805 | 8/1937 | Chuse . |
| 2,753,766 | 7/1956 | Simpson . |
| 2,861,354 | 11/1958 | Hultgreen . |
| 2,926,116 | 2/1960 | Keim . |
| 3,052,991 | 9/1962 | Goldner . |
| 3,058,873 | 10/1962 | Keim et al. . |
| 3,084,448 | 4/1963 | Dungler . |
| 3,176,412 | 4/1965 | Gardner . |
| 3,208,158 | 9/1965 | Smith, Jr. . |
| 3,220,914 | 11/1965 | Boadway et al. . |
| 3,224,926 | 12/1965 | Bernardin . |
| 3,224,928 | 12/1965 | Lee et al. . |
| 3,284,285 | 11/1966 | Holden . |
| 3,301,746 | 1/1967 | Sanford et al. . |
| 3,303,576 | 2/1967 | Sisson . |
| 3,319,354 | 5/1967 | Hering, Jr. et al. . |
| 3,340,617 | 9/1967 | Carroll, Jr. . |
| 3,371,427 | 3/1968 | Thygeson, Sr. . |
| 3,434,922 | 3/1969 | Ely . |
| 3,447,247 | 6/1969 | Daane . |
| 3,455,778 | 7/1969 | Bernardin . |
| 3,537,954 | 11/1970 | Justus . |
| 3,541,697 | 11/1970 | Villalobos . |

(List continued on next page.)

FOREIGN PATENT DOCUMENTS

| | | |
|---|---|---|
| 677083 | 12/1963 | (CA) . |
| 0 033 559 A2 | 8/1981 | (EP) . |
| 0 328 227 A2 | 8/1989 | (EP) . |

(List continued on next page.)

OTHER PUBLICATIONS

Bieman, Leonard H., Kevin G. Harding, and Albert Boehnlein, "Absolute Measurement Using Field Shifted Moiré," Optics, Illumination, and Image Sensing for Machine Vision VI, SPIE Proceedings Series, Nov. 14–15, 1991, vol. 1614, pp. 259–264.

(List continued on next page.)

*Primary Examiner*—Anthony Knight
*Assistant Examiner*—John L. Beres
(74) *Attorney, Agent, or Firm*—Thomas J. Connelly; Patricia A. Charlier

(57) ABSTRACT

An apparatus is disclosed for maintaining a fluid seal with a moving substrate. The apparatus includes an enclosure and a cap. The enclosure has a first surface and a second surface with the first surface being in sealing contact with the moving substrate. The cap seals off the second surface of the enclosure. The cap is secured to the enclosure at at least two spaced apart locations and has a non-secured portion that is capable of deflecting independently of the enclosure. The apparatus further includes means for introducing a pressurized fluid into the enclosure. The pressurized fluid creates a net force on the enclosure of zero and a force on the cap which causes a portion of the cap to deflect. The deflection of the cap allows the first surface of the enclosure to remain in sealing contact with the moving substrate.

20 Claims, 4 Drawing Sheets

U.S. PATENT DOCUMENTS 3,574,261 4/1971 Bailey .
3,577,651 5/1971 Nichols .
3,587,177 6/1971 Overly et al. .
3,599,341 8/1971 Darcy et al. .
3,607,624 9/1971 Moody et al. .
3,617,442 11/1971 Hurschman .
3,629,056 12/1971 Forrest .
3,657,069 4/1972 Candor et al. .
3,729,376 4/1973 Stevens .
3,771,236 11/1973 Candor et al. .
3,771,239 11/1973 Minoda et al. .
3,810,818 5/1974 Arledter .
3,812,598 5/1974 Lefebvre et al. .
3,822,182 7/1974 Heyse et al. .
3,844,881 10/1974 Moody .
3,849,904 11/1974 Villalobos .
3,879,257 4/1975 Gentile et al. .
3,895,449 7/1975 Chance et al. .
3,913,241 10/1975 Chaikin et al. .
3,923,593 12/1975 Verseput .
3,930,319 1/1976 Coleman .
3,939,576 * 2/1976 Lawrence .
3,994,771 11/1976 Morgan, Jr. et al. .
4,072,557 2/1978 Schiel .
4,074,441 2/1978 Helversen et al. .
4,089,194 5/1978 Sando et al. .
4,102,737 7/1978 Morton .
4,120,747 10/1978 Sarge, III et al. .
4,121,968 10/1978 Wells .
4,125,430 11/1978 Grossman .
4,157,938 6/1979 Clemens et al. .
4,163,688 8/1979 Kankaanpaa .
4,183,147 1/1980 Kawaguchi .
4,197,973 4/1980 Daane .
4,201,323 5/1980 Stibbe et al. .
4,285,816 8/1981 Lee .
4,309,246 1/1982 Hulit et al. .
4,345,385 8/1982 Sando et al. .
4,356,059 10/1982 Hostetler .
4,359,827 11/1982 Thomas .
4,359,828 11/1982 Thomas .
4,361,466 11/1982 Wong et al. .
4,364,185 12/1982 Dussourd et al. .
4,421,600 12/1983 Hostetler .
4,440,597 4/1984 Wells et al. .
4,444,622 4/1984 Dove .
4,462,868 7/1984 Oubridge et al. .
4,528,316 7/1985 Soerens .
4,529,480 7/1985 Trokhan .
4,541,895 9/1985 Albert .
4,547,266 10/1985 Keller et al. .
4,551,199 11/1985 Weldon .
4,555,988 * 12/1985 Pankoke .
4,556,450 12/1985 Chuang et al. .
4,559,105 12/1985 Sennett et al. .
4,571,359 2/1986 Dutt .
4,632,722 * 12/1986 Pankoke .
4,637,859 1/1987 Trokhan .
4,787,641 11/1988 Rautakorpi et al. .
4,835,880 6/1989 Vecchia .
4,849,054 7/1989 Klowak .
4,871,425 10/1989 Gunderson .
4,888,096 12/1989 Cowan et al. .
4,892,622 1/1990 Malkki et al. .
4,899,461 2/1990 Lehtinen .
4,915,788 4/1990 Winheim .
4,953,297 9/1990 Eskelinen et al. .
4,958,444 9/1990 Rautakorpi et al. .
4,976,821 12/1990 Laapotti .
4,986,009 1/1991 Haessner et al. .
5,043,046 8/1991 Laapotti .
5,048,589 9/1991 Cook et al. .
5,070,627 12/1991 Zagar .
5,070,628 12/1991 Zagar .
5,078,835 1/1992 Schiel et al. .
5,085,737 2/1992 Brogyanyi et al. .
5,105,562 4/1992 Hella et al. .
5,129,988 7/1992 Farrington, Jr. .
5,137,600 8/1992 Barnes et al. .
5,149,401 9/1992 Langevin et al. .
5,187,219 2/1993 Furman, Jr. .
5,225,042 7/1993 Eaton et al. .
5,230,776 7/1993 Andersson et al. .
5,262,010 11/1993 Bubik et al. .
5,274,930 1/1994 Ensign et al. .
5,336,373 8/1994 Scattolino et al. .
5,348,620 9/1994 Hermans et al. .
5,381,580 1/1995 Kotitschke et al. .
5,411,636 5/1995 Hermans et al. .
5,429,686 7/1995 Chiu et al. .
5,471,765 12/1995 Rautakorpi et al. .
5,490,903 2/1996 Chen et al. .
5,501,768 3/1996 Hermans et al. .
5,508,095 4/1996 Allum et al. .
5,556,053 9/1996 Henseler .
5,594,996 1/1997 Haavisto .
5,594,997 1/1997 Lehtinen .
5,598,643 2/1997 Chuang et al. .
5,601,871 2/1997 Krzysik et al. .
5,604,995 2/1997 Lehtinen et al. .
5,607,551 3/1997 Farrington, Jr. et al. .
5,611,893 3/1997 Pajula et al. .
5,620,566 4/1997 Holopainen .
5,625,961 5/1997 Ensign et al. .
5,656,132 8/1997 Farrington, Jr. et al. .
5,667,636 9/1997 Engel et al. .
5,689,897 11/1997 Schiel .
5,743,999 4/1998 Kamps et al. .
5,746,887 5/1998 Wendt et al. .
5,772,845 6/1998 Farrington, Jr. et al. .
5,830,321 11/1998 Lindsay et al. .
5,975,532 * 11/1999 Karttunen et al. .
5,990,377 11/1999 Chen et al. .
6,080,279 6/2000 Hada et al. .
6,080,691 6/2000 Lindsay et al. .
6,083,346 7/2000 Hermans et al. .
6,093,284 7/2000 Hada et al. .
6,096,169 8/2000 Hermans et al. .
6,120,642 9/2000 Lindsay et al. .
6,143,135 11/2000 Hada et al. .
6,149,767 11/2000 Hermans et al. .

FOREIGN PATENT DOCUMENTS 0 502 602 A1 9/1992 (EP) .
0 574 366 A1 12/1993 (EP) .
0 616 074 A1 9/1994 (EP) .
679 469 4/1930 (FR) .
1235868 5/1960 (FR) .
2 303 116 10/1976 (FR) .
1057373 2/1967 (GB) .
2 014 255 A 8/1979 (GB) .
2 152 961 A 8/1985 (GB) .
2 179 949 A 3/1987 (GB) .
2 179 953 A 3/1987 (GB) .
2 235 754 A 3/1991 (GB) .
2 254 288 B 10/1992 (GB) .
2 303 647 A 2/1997 (GB) .
WO 90/04676 A1 5/1990 (WO) .
WO 91/16493 A1 5/1990 (WO) .

WO 93/23616 A1 11/1993 (WO) .
WO 95/00706 A1 1/1995 (WO) .
WO 96/38232 A1 12/1996 (WO) .
WO 97/43483 A1 11/1997 (WO) .
WO 97/43484 A1 11/1997 (WO) .
WO 99/23296 A 5/1999 (WO) .
WO 99/23300 A1 5/1999 (WO) .
WO 99/51812 A1 10/1999 (WO) .
97/7002 4/1998 (ZA) .
98/9270 6/1999 (ZA) .
98/9272 6/1999 (ZA) .
98/9733 7/1999 (ZA) .

OTHER PUBLICATIONS

Bowden, Edward V., "Non–Contact Drying and Turning—the 'On Machine' Technology of the Nineties," Appita, vol. 44, No. 1, Jan. 1991, pp. 41–46.

Derwent World Patent Database abstract of JP 72–034645 B: Description of Tomioka MCH (Tom–I), "Pressurizing and Heating Apparatus."

Haberl, Andrew et al., "First Linerboard Application Of The Gas Heated Paper Dryer," 45th Appita Annual General Conference Proceedings, vol. 1, 1991, pp. 47–50.

Kufferath, W. et al., "Die Sonic–Roll," Das Papier, 42(10A): V140, 1988.

Lindsay, Jeffrey D. and Leonard H. Bieman, "Exploring Tactile Properties of Tissue With Moire Interferometry," Non–Contact, Three–Dimensional Gaging Methods and Technologies Workshop, Dearborn, Michigan, Mar. 1997.

Lindsay, Jeffrey D., "Displacement Dewatering To Maintain Bulk," Paperi Ja Puu–Paper And Timber, vol. 74, No. 3, 1992, pp. 232–242.

Mummery, Leigh, Surface Texture Analysis: The Handbook, published by Hommelwerke GmbH, Muhlhausen, Germany, 1990, pp. 37–45.

Page, R.H. and J. Seyed–Yagoobi, "A New Concept For Air Or Vapor Impingement Drying," Tappi Journal, 73(9), Sep. 1990, pp. 229–234.

Tappi Official Test Method T 494 om–88, "Tensile Breaking Properties Of Paper And Paperboard (Using Constant Rate Of Elongation Apparatus)," published by the Tappi Press, Atlanta, Georgia, revised 1988, pp. 1–5.

Tappi Useful Method UM 256, "Water Retention Value (WRV)," published by the Tappi Press, Atlanta, Georgia, pp. 54–56.

Thiele, P.E. et al., "Enhancement Of Drying Rate, Moisture Profiling And Sheet Stability On An Existing Paper Machine With RJR Blow Boxes," 1995 Papermakers Conference, Tappi Press, Atlanta, Georgia, 1995, pp. 223–228.

Economy, Prof. J. and University of Illinois at UrbanaChampaign, "Activated Carbon Fabrics," http://www.students.uiuc.edu/~ahall/acf.html, Mar. 23, 1999, pp. 1–4 and Figures pp. 1–3.

* cited by examiner

APPARATUS FOR MAINTAINING A FLUID SEAL WITH A MOVING SUBSTRATE

FIELD OF THE INVENTION

The present invention relates to an apparatus for maintaining a fluid seal with a moving substrate. More particularly, this invention relates to a pressure chamber designed to maintain uniform sealing contact with a moving substrate despite the existence of deflection forces resulting from a pressure differential between ambient conditions and the inside of the pressure chamber.

BACKGROUND OF THE INVENTION

An air press is a mechanical device that is designed to assist in removing water from a moving web. The air press includes a positive pressure chamber, i.e. a pressure plenum placed in sealing relation with a moving substrate, and a negative pressure chamber, i.e. a vacuum device, positioned on the opposite side of the moving substrate. The moving substrate may include a tissue web sandwiched between two supporting fabrics, and the pressure differential across the moving substrate establishes airflow through the substrate. The airflow is normally used to dewater a tissue web.

The effectiveness of such an air press, as well as the effectiveness of many other types of pressure chambers, is partly a function of the seal quality that the pressure chamber forms with the moving substrate. As used herein, a "moving substrate" can refer to a paper web, a paper manufacturing felt or fabric, a roll surface, or a sandwich of a paper web between two supporting or transfer fabrics. Unfortunately, the difficulty associated with maintaining a proper seal increases, as the cross-machine length of the pressure chamber becomes longer or the pressure differential from ambient is increased. Specifically, the pressure differential between the interior of the pressure chamber and ambient conditions generates deflection forces tending to cause the pressure chamber to bow in the cross-machine direction away from the moving substrate. The bowing of the pressure chamber away from the moving substrate compromises the chamber's seal to the moving substrate. This can result in leakage either into or out of the pressure chamber or a cross-machine direction variation in load that can result in accelerated local fabric wear.

A "pressure chamber", as used herein, refers to a chamber in which the interior is at a pressure either higher or lower than atmospheric pressure.

The bowing phenomena are especially problematic on a paper machine because the pressure chamber can only be restrained from deflection on the two ends outside the manufactured web. Structural restraints positioned at locations between the ends would interfere with the paper manufacturing process, and generally are not feasible in a modern papermaking machine. Current papermaking economics dictates a paper machine as wide as possible, and what frequently limits the ability to build a wider paper machine is deflection of the cross-machine components.

Current methods for reducing the deflection of cross-machine components include increasing the cross-section of the component and hence its second moment of inertia or machining an intentional deflection into the component opposite the component's deflection when in a paper machine. A larger cross-section reduces deflection; however, this leads to an increase in the dimensions of the component that may not be practical because of limited space and greater cost. As an example, minimization of the cross-machine deflection of a paper machine roll is critical to proper tracking of fabrics and felts. Wider paper machines require roll diameters that are much larger in diameter, when compared on a proportional basis, to the increase in width between the narrower paper machine and the wider paper machine. Because the required roll diameter dramatically increases, the cost of these rolls and the space needed also dramatically increases. It is important to note that increasing the size of the components can reduce the deflection, but such an increase never eliminates the deflection.

Deflection is controlled by a material property called Young's Modulus. Young's Modulus is defined as the ratio of applied unit load, expressed as stress, to the elongation, expressed as strain, of the specimen. A higher Young's Modulus means a specimen will not deflect as much under a given load when compared to a specimen with a lower Young's Modulus. A potential method of reducing deflection could be to select a material with a higher Young's Modulus. Metals, particularly iron-bearing alloys such as steel and stainless steel, already have the highest Young's Modulus for commonly available materials. Thus, few opportunities exist for alternate material selection from which to construct paper machine components in a cost-effective manner.

Another method of reducing the effect of deflection is to manufacture the components in such a manner that the component is deflected when in the unloaded state. The component then assumes a "zero deflection state" upon application of the load. Actually, the component still is deflected due to the load, but is deflected to a desired position upon application of the load. This is accomplished by applying the expected load to the component, while it is supported at its ends, and then machining the component to the desired profile. This process is effective where the load is constant and known, but it is evident that the desired profile is only possible at the load applied during machining. If the actual load varies, or is different from the applied load during machining, the component will not have the desired profile while in use.

For all these methods, it is important to note that deflection continues to be proportional to the load or force applied to the component. For example, cross-machine deflection of a pressure chamber is proportional to the actual pressure in the chamber. Furthermore, any deflection of the cross-machine components in a paper machine is undesirable. The previous methods help to control deflection, with the aforementioned disadvantages, but the deflection of the component remains.

Therefore, what is needed is a pressure chamber that eliminates sealing problems caused by cross-machine deflection of the pressure chamber. Such a pressure chamber's cross-machine deflection will not change as the internal pressure of the chamber is changed. Relatedly, what is also lacking and needed is a more efficient method for treating a moving substrate with a fluid in a pressure chamber.

SUMMARY OF THE INVENTION

Briefly, this invention relates to an apparatus for maintaining a fluid seal with a moving substrate. The apparatus includes an enclosure and a cap. The enclosure has a first surface and a second surface with the first surface being in sealing contact with the moving substrate. The cap functions to seal off the second surface of the enclosure. The cap is secured to the enclosure at at least two spaced apart locations and the cap has a non-secured portion that is capable of deflecting independently of the enclosure. The apparatus further includes means for introducing a pressurized fluid into the enclosure. The pressurized fluid creates a net force on the enclosure of zero and an upward force on the cap which causes a portion of the cap to deflect. The deflection of the cap allows the first surface of the enclosure to remain in sealing contact with the moving substrate.

The general object of this invention is to provide a pressure chamber, which seals to a moving substrate, such that the deflection of the chamber due to a pressurized fluid does not interfere with the seal to the moving substrate. A more specific object of this invention is to provide a pressure chamber, suitable for use in a paper manufacturing process, to dewater a paper web by means of pressurized air.

Another object of this invention is to provide a pressure chamber that uses a minimum of materials, and weighs less than a pressure chamber reinforced by use of additional materials in an attempt to reduce pressure deflections.

A further object of this invention is to provide a pressure chamber that functionally can minimize leakage of the pressurized fluid.

Still another object of this invention is to provide a pressure chamber, in sealing contact with a moving substrate, that is capable of operation on a paper machine having a relatively small cross-sectional area, and a long cross-machine direction length.

Other objects and advantages of the present invention will become apparent to those skilled in the art in view of the following description and the accompanying drawings.

DETAILED DESCRIPTION OF THE PREFERRED EMBODIMENTS

Figure 1:
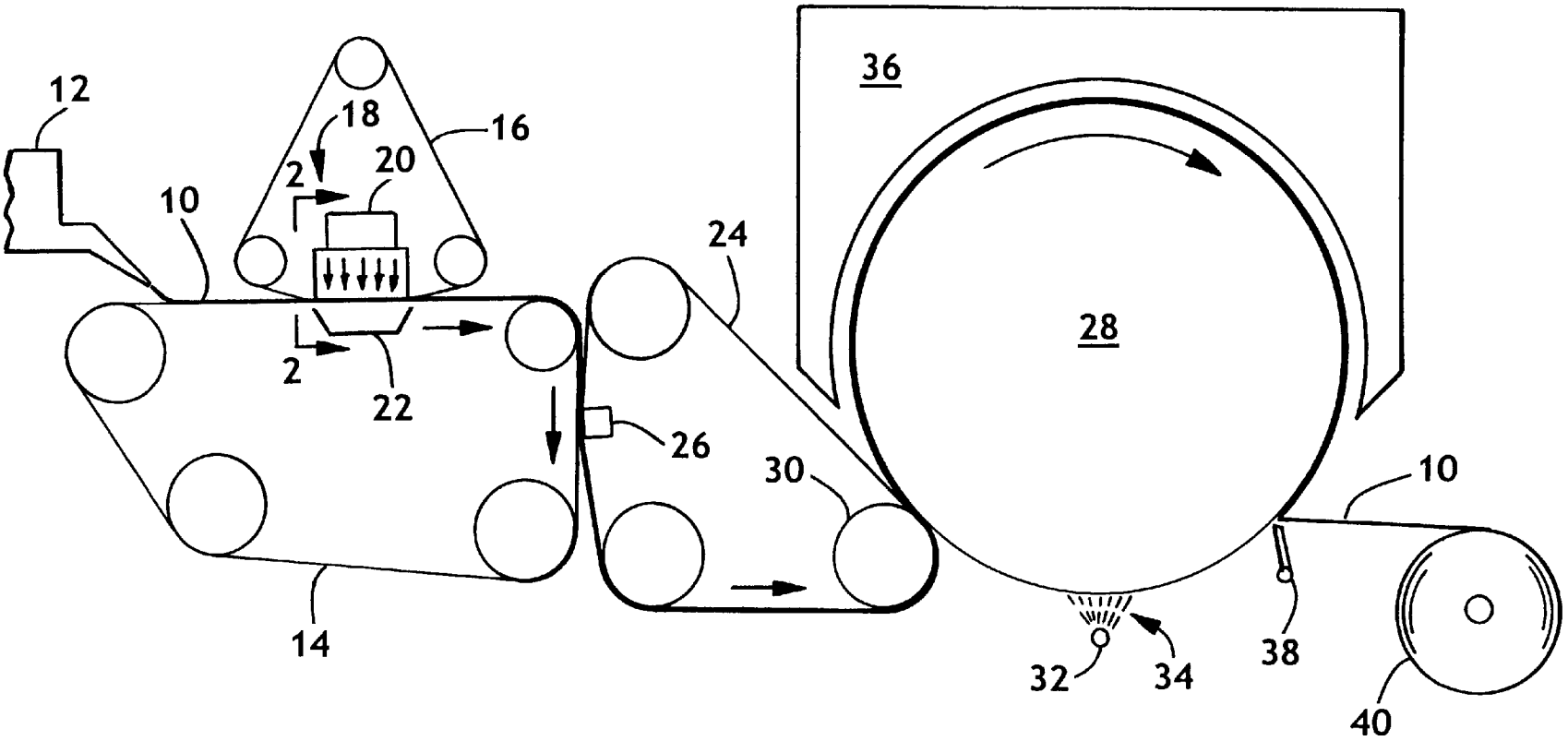
FIG. 1 is a schematic of a paper manufacturing process utilizing a pressure chamber.

This invention will now be described in greater detail with reference to the Figures, where similar elements in different Figures have been given the same reference numeral. FIG. 1 illustrates a paper manufacturing process utilizing a pressure chamber constructed according to the present invention in an application to dewater a paper web. It is noted that while the pressure chamber in this application is used to dewater a paper web, other useful applications for the pressure chamber exist, and its application is not to be limited only to that shown in FIG. 1.

In FIG. 1, a paper web 10 is formed as a slurry of papermaking fibers which is discharged from a headbox 12 and deposited onto an endless loop of foraminous forming fabric 14. The wet paper web 10 is sandwiched between the forming fabric 14 and a support fabric 16 as it is carried past an air press 18. The air press 18 includes a pressure chamber 20, constructed in accordance with the current invention, and disposed in operable relationship to a vacuum box 22. The vacuum box 22 can be of conventional papermaking apparatus design. In operation, the pressure chamber 20 is pressurized with a fluid.

As used herein, "fluid" refers to either a liquid or a gaseous substance such as water or air. Fluid also refers to a colloidal dispersion of solids in a liquid, such as a coating solution used in paper manufacturing. Fluid also refers to a colloidal dispersion of liquids in a gas, such as droplets of chemicals suspended in air. Finally, fluid also refers to particles of solid material dispersed in a gas. In the paper making process shown, the fluid is preferably pressurized air that passes from the pressure chamber 20 to the vacuum box 22 through the paper web 10 for the purpose of removing water.

After removal of water by the air press 18, the paper web 10 is transferred to a transfer fabric 24 by a vacuum transfer shoe 26. The paper web 10 is then pressed against an exterior surface of a Yankee dryer 28 by a pressure roll 30. A spray boom 32 applies a creping adhesive 34 to the Yankee dryer 28 adhering the paper web 10 to the exterior surface of the Yankee dryer 28. The Yankee dryer 28 in cooperation with a dryer hood 36 then remove most of the remaining water from the paper web 10. A creping blade 38 crepes the paper web 10 off the Yankee dryer 28, which is then wound into a paper reel 40. The paper web 10 made by this process is suitable for use in a tissue product such as bath, facial, towels, napkins, and the like; however, the air press 18 could be used to dewater any paper grade.

The pressure chamber 20 is suitable for other applications, and it is not limited to dewatering applications. For instance, the fluid could be a chemical disposed in air or a mixture of chemicals and air. The pressure chamber 20 is then used to apply the chemicals to the moving substrate. This would keep the applied chemicals separated from other process water used to dilute the paper making fibers prior to the headbox 12. Potential chemical interactions could be avoided by applying the additional chemicals separately, as opposed to addition in the stock preparation system with other desirable chemicals.

Another application for the pressure chamber 20 would be to maintain a uniform seal adjacent to a rotating roll during a coating application. The pressure chamber 20 could be used in place of a chamber box in a typical coating application. The pressure chamber 20 would be placed adjacent to an engraved roll or an anilox roll of a roll coater or flexographic press. The fluid may be a coating solution or ink which is transferred to the roll surface and then later transferred to the paper web.

Yet another application is an improved vacuum box design where deflection could be minimized for varying levels of vacuum. For instance, two pressure chambers could be placed on opposite sides of the moving substrate. One chamber operated at a positive pressure, and the other chamber at a negative pressure.

Figure 2:
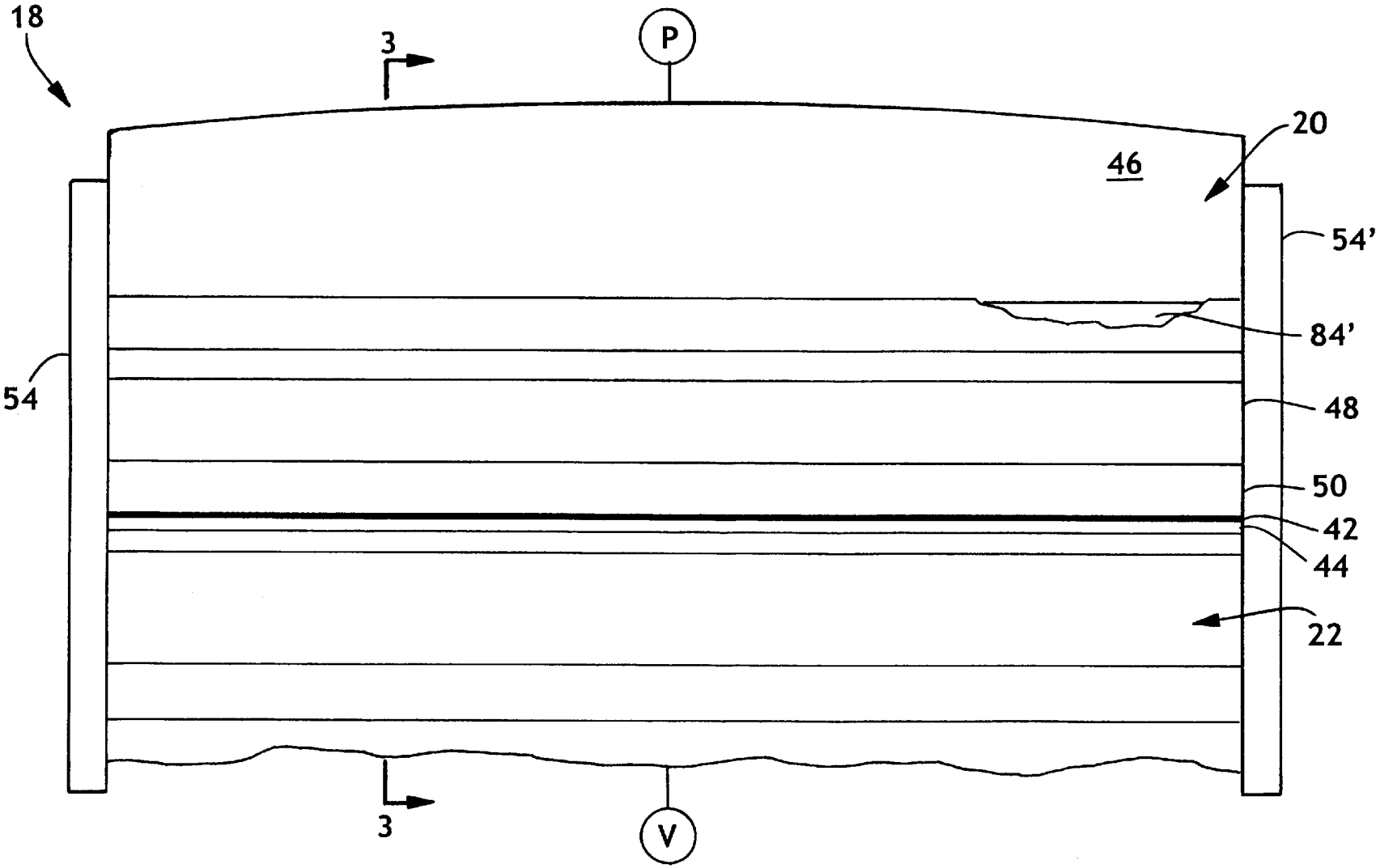
FIG. 2 is a side-view of the pressure chamber shown in FIG. 1, taken along line 2—2 and depicting the cross-machine direction.

Referring now to FIG. 2, the air press 18 of FIG. 1 is shown in the cross-machine view during operation. The air press 18 includes the pressure chamber 20 and the vacuum box 22. A moving substrate 42 consists of the paper web 10 sandwiched between the forming fabric 14 and the support fabric 16, see FIG. 1. The moving substrate 42 is positioned between the pressure chamber 20 and the vacuum box 22. Sealing the vacuum box 22 to the moving substrate 42 are vacuum box seals 44 and 44'. A negative pressure is introduced to the vacuum box 22 by suitable means (not shown). Suitable equipment can include a blower, a high-speed centrifugal fan, a vacuum pump, a venturi, or any other equipment for creating a vacuum.

The pressure chamber 20 further includes a cap 46 and an enclosure 48. A pair of enclosure seals 50 and 50' seal the enclosure 48 to the moving substrate 42. A pair of cap seals 52 and 52', shown in FIG. 3, seal the cap 46 to the enclosure 48. A pair of end plates 54 and 54' constrains movement of the cap 46 relative to the enclosure 48 at the ends preventing the cap 46 from lifting out of engagement with the pair of cap seals 52 and 52' during operation. The end plates 54 and 54' are spaced apart and preferably are aligned opposite to one another. The cap 46 is free to move independently of the enclosure 48 at locations between the two end plates 54 and 54' by sliding relative to the enclosure 48. Each of the end plates 54 and 54' can also support the vacuum box 22 as shown, although it may be desirable to mount the vacuum box 22 on or secure it to separate framework. Separate framework would facilitate retracting the pressure chamber 20 and the vacuum box 22 independently from the moving substrate 42 by appropriate means not shown.

During operation, a pressured fluid is introduced into the pressure chamber 20 by suitable means. Suitable means can include a compressor, a high-speed centrifugal fan, a pump, an elevated reservoir, or any other means of pressurizing a fluid. The enclosure seals 50 and 50' and the pair of cap seals 52 and 52' maintain the fluid pressure in the pressure chamber 20. The pressurized fluid in the pressure chamber 20 acts to deflect the pressure chamber 20 hydrostatically by pushing against all interior surfaces as well as against the moving substrate 42. Because the pressure chamber 20 is supported only at the ends in a typical paper machine application, the cap 46 bows as is depicted in FIG. 2.

If the cap 46 were rigidly attached to the enclosure 48 at all locations, the enclosure 48 would also bow, and the seals 50 and 50' formed with the moving substrate 42 would be compromised. Because the cap 46 is only fixed relative to the enclosure 48 at the end plates 54 and 54', the enclosure 48 does not bow from the fluid pressure. Thus, the effective seals 50 and 50' formed with the moving substrate 42 are maintained.

Figure 3:
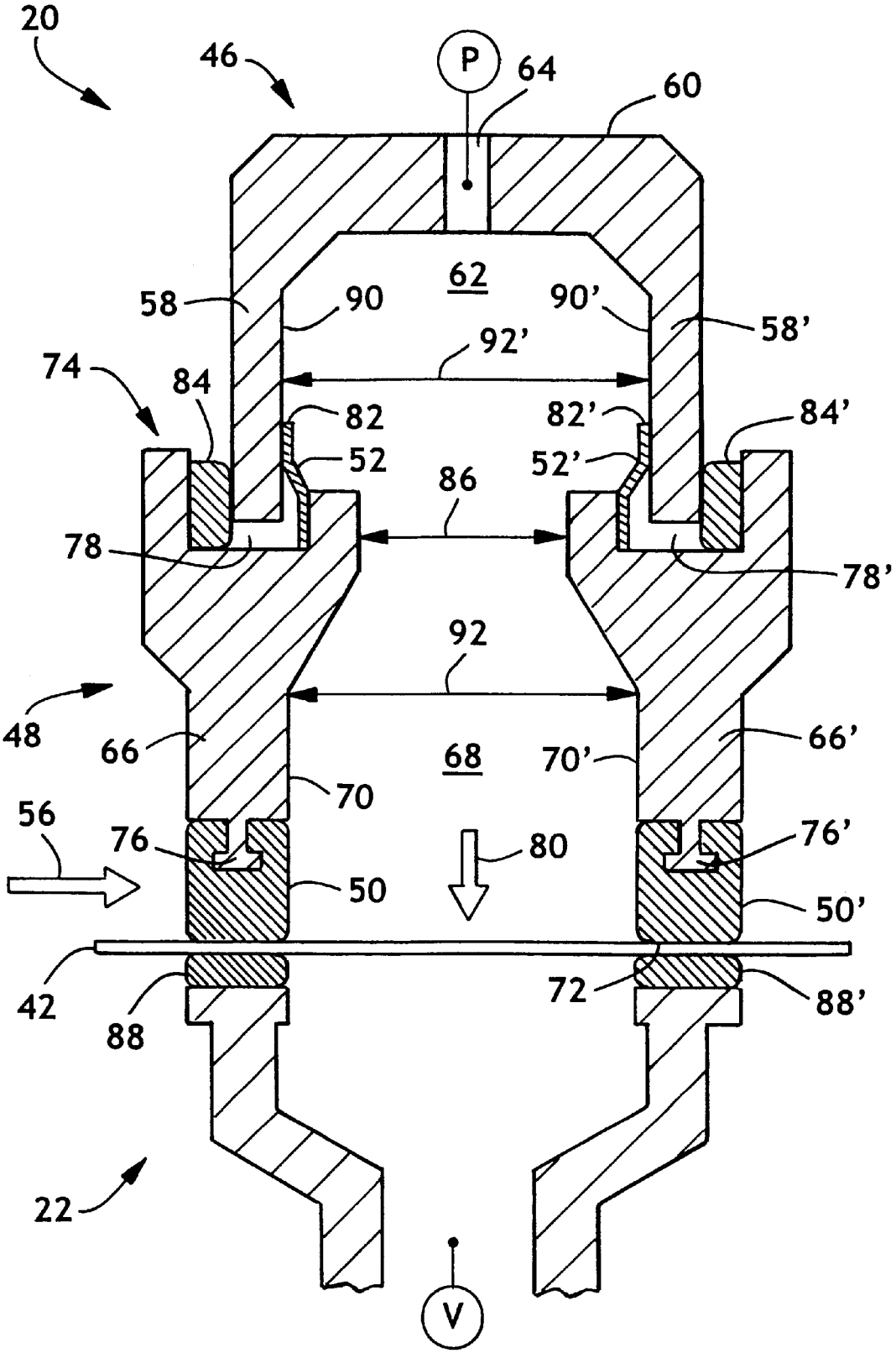
FIG. 3 is a cross-sectional view of the pressure chamber shown in FIG. 2 taken along line 3—3.

Referring now to FIG. 3, the construction of the pressure chamber 20 is shown in greater detail. The moving substrate 42 is moving relative to the pressure chamber 20 in a machine direction illustrated by an arrow 56. In one embodiment, the moving substrate 42 consists of a tissue web sandwiched between a pair of fluid permeable fabrics (not shown). The pressure chamber 20 is positioned on one side of the moving substrate 42, and it is operatively associated with the vacuum box 22 positioned on the opposite side of the moving substrate 42. Air, as the pressurized fluid, travels through the moving substrate 42 removing water. The air and water is then evacuated by the vacuum box 22. Alternatively, a support pan or other device could be used to collect the water removed or expressed by the pressure chamber 20, or the pressure chamber 20 could be used without such a collection device.

The pressure chamber 20 includes the cap 46 and the enclosure 48 that are operatively associated with one another. In particular, and as described in greater detail hereinafter, the cap 46 and the enclosure 48 are moveable relative to one another such that the cap 46 can deflect without affecting the position of the enclosure 48. At their cross-machine direction ends, the cap 46 and the enclosure 48 are rigidly connected by the pair of end plates 54 and 54', see FIG. 2. Alternatively, the cap 46 and the enclosure 48 may be attached to separate frame members at their respective ends (not shown). The vacuum box 22 may optionally be mounted to the pair of end plates 54 and 54' as well. In addition, as described in greater detail hereinafter, the cap 46 and the enclosure 48 are sealed with respect to one another to reduce or eliminate the loss of pressurized fluid from within the pressure chamber 20.

The cap 46 is constructed of a pair of opposing walls 58 and 58' and a roof 60, which together define a chamber 62, referred to as a second chamber. The walls 58 and 58' can be vertically oriented so as to extend upward relative to the enclosure 48. A port 64 is formed in the cap 46 and provides a connection between the second chamber 62 and a source of pressurized fluid. The port 64 is shown formed in the roof 60 but it could also be formed at any location in the cap 46 or the enclosure 48 as long as it does not interfere with the deflection of the cap 46. It should be noted that a flexible joint would be required for a pressurized fluid connection to the movable part of the cap 46.

Suitable materials for constructing the cap 46 include steel, iron, or other metals, or any other material strong enough to withstand the stresses associated with the internal pressure of the pressure chamber 20. The pair of opposing walls 58 and 58' of the cap 46 and the roof 60 may be integral or separate elements. The cap 46 is preferably a U-shaped channel structure, as shown in FIG. 3. Alternatively, the cap 46 could have a semi-circle configuration obtained by cutting a circular pipe lengthwise or any other convenient shape.

The enclosure 48 includes a pair of opposing walls 66 and 66' that define a first chamber 68 therebetween. The pair of opposing walls 66 and 66' forms a pair of inside surfaces 70 and 70'. The pair of inside surfaces 70 and 70' may be connected by bars, beams, rods or the like (not shown) for structural support and to prevent the pair of opposing walls 66 and 66' from deflecting outward due to the pressurized fluid in the first chamber 68. Spacing, location, and design of the bars could be determined by a structural analysis of the enclosure 48 at the maximum anticipated operating pressure. Suitable materials for constructing the enclosure 48 include steel, iron, or other metals, or any other material strong enough to withstand the stresses associated with the internal pressure of the pressure chamber 20.

The enclosure 48 is adapted to contact and form a seal with the moving substrate 42. The enclosure 48 has a first or lower surface 72 in sealing contact with the moving substrate 42, and a second or upper surface 74 in sealing contact with the cap 46. The pair of enclosure seals 50 and 50' are located approximate the first surface 72 and are positioned to contact the moving substrate 42. The pair of enclosure seals 50 and 50' may be slideably mounted on a pair of inverted T-shaped seal-mounts, 76 and 76' respectively, for ease of replacement.

The pair of enclosure seals 50 and 50' desirably ride uniformly on the moving substrate 42 to minimize escape of the pressurized fluid between the pressure chamber 20 and the moving substrate 42. The pair of enclosure seals 50 and 50' are desirably shaped and formed in a manner that minimizes wear or other disruption of the moving substrate 42. In a particular embodiment, the pair of enclosure seals 50 and 50' are formed of resilient plastic compounds, ceramic, coated metal substrates, or the like. The pair of enclosure seals 50 and 50' are secured to and supported on the pair of opposing walls, 66 and 66' respectively, by the pair of mounting members 76 and 76'. The pair of mounting members 76 and 76', may be formed from the same variety of materials as the pair of enclosure seals 50 and 50', or they may be formed from the same variety of materials from which the enclosure 48 is made of.

Other types of enclosure sealing means can also be used to seal the enclosure 48 to the moving substrate 42. One such sealing means is an inflatable bladder. The bladder is inflated to hold the enclosure 48 in sealing contact with the moving substrate 42.

To accommodate deflection forces caused by the difference in pressure inside and outside of the pressure chamber 20, the cap 46 and the enclosure 48 are adapted to move relative to one another. The ends of the cap 46 and the enclosure 48 are rigidly secured together by the pair of end plates 54 and 54'. At other locations, the cap 46 is allowed to bow away from the enclosure 48 without disrupting the uniform seal formed between the enclosure 48 and the moving substrate 42.

Still referring to FIG. 3, the upper end of the pair of opposing walls 66 and 66' establish the second surface 74. A pair of recessed grooves 78 and 78' is formed in the second surface 74. When the pair of walls 66 and 66' is spaced apart and aligned parallel to one another, the pair of recessed grooves 78 and 78' can be formed in the upper end thereof. Each recessed groove 78 and 78' can have a U-shape, a V-shape, or some other suitable shape so as to allow the cap 46 to be inserted into the enclosure 48. The bottom portion of each of the walls 58 and 58', which form the cap 46, partially reside within one of the pair of recessed grooves 78 and 78'. Each wall 58 and 58' is sealed by appropriate means to lo minimize loss of the pressurized fluid from the second chamber 62. The cap 46 is able to move axially away from the enclosure 48 at at least one other cross-machine location, other than at the ends where the cap 46 and the enclosure 48 are secured together. Preferably, the cap 46 is free to move outward at all cross-machine locations other than at the ends. The axial movement of the cap 46 is generally along the line of fluid flow shown by an arrow 80, but it may be either towards the moving substrate 42 or away from the moving substrate 42 depending on the internal pressure.

Still referring to FIG. 3, the pair of cap seals 52 and 52' function to form a fluid seal between the cap 46 and the enclosure 48. Each cap seals 52 and 52' is placed in one of the recessed grooves 78 and 78' and contacts the interior surface of the respective opposing wall 58 and 58' to prevent the escape of the pressurized fluid. Most desirably, each of the cap seals 52 and 52' is fixedly attached to a side surface of one of the recessed grooves 78 and 78', and is in slideable contact with the interior of the respective opposing wall 58 and 58'. These arrangement increases the effectiveness of the pair of cap seals 52 and 52' by increasing the seal contact pressure as the pressure of the second chamber 62 increases.

Figure 4:
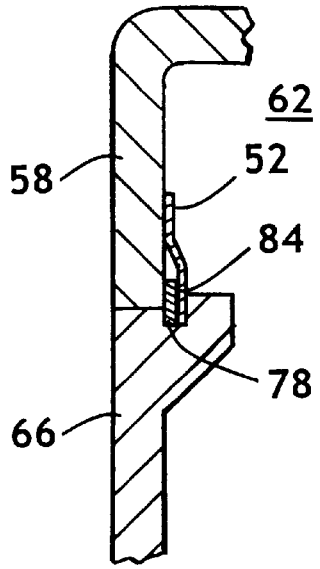
FIG. 4 is a partial sectional view of an alternative embodiment for joining the cap to the enclosure.

Referring to FIG. 4, it should be noted that other designs for attaching or joining the walls 58 and 58' of the cap 46 to the walls 66 and 66' of the enclosure 48 are possible. In FIG. 4, the bottom portion of the wall 58 is shown abutting against the top portion of the wall 66. The cap seal 52 and the support member 84 are located in a groove 78 and are aligned to the inside of the wall 58. The cap seal 52 can be in slideable contact with the interior surface of the wall 58 so as to prevent the escape of pressurized fluid from the second chamber 62.

Each of the cap seals 52 and 52' is preferably formed from a thin sheet of stainless steel sheet metal. The proper thickness of the material is calculated from the material's Young's Modulus such that a seal is formed when the material deflects due to the applied pressure of the fluid in the second chamber 62. A seal occurs when an end 82 and 82' of each seal, 52 and 52' respectively, is pushed into contact with the interior surface of the opposing walls 58 and 58'. Alternatively, each of the seals 52 and 52' can be in physical contact with one of so the walls 58 and 58' at all times, and the internal pressure would be used to increase the sealing force. Such a seal design can minimize the escape of the pressurized fluid, yet will allow the cap 46 to slide freely relative to the pair of cap seals 52 and 52'.

Other suitable materials for constructing the cap seals 52 and 52' include various plastics; sheet metal such as spring steel, stainless steel, bronze, and the like; and composite structures such as fiberglass, graphite, carbon fiber impregnated resins, and the like.

As shown in FIG. 3, a pair of support members 84 and 84' are positioned in each of the recessed grooves 78 and 78'. The support members 84 and 84' are arranged to contact the outside surface of each of the opposing walls 58 and 58'. The support members 84 and 84' can be formed from a low friction, wear resistant material such as bronze, brass, plastic, or the like. The support members 84 and 84' function to provide lateral alignment of the cap 46 in the recessed grooves 78 and 78'. The support members 84 and 84' also help eliminate binding between the cap 46 and the enclosure 48 thereby ensuring proper operation of the pressure chamber 20. Binding may be further eliminated by providing the cap 46 with internal braces connecting the pair of opposing walls 58 and 58' with bars, beams, rods or the like (not shown) for structural support. This will minimize the opposing walls 58 and 58' from deflecting outward due to the pressurized fluid in the second chamber 62. The bars would be designed to reduce bowing of the opposing walls 58 and 58' while not interfering with upward deflection of the cap 46.

In operation, a pressurized fluid is supplied to the second chamber 62 via a pressure source P. The first and second chambers, 68 and 62 respectively, are in fluid communication through an enclosure opening 86. Pressurized fluid is present in both of the first and second chambers 68 and 62, respectively, and is able to pass in the direction of the arrow 80 toward the moving substrate 42. When the pressure chamber 20 is employed to dewater a moving tissue, the water removed from the tissue by the pressurized fluid will be collected by the vacuum box 22. The vacuum box 22 desirably includes the pair of vacuum box seals 44 and 44' formed of a low friction and/or low wear material. Each of the vacuum box seals 44 and 44' contact the moving substrate 42, thereby minimizing leakage of air into the vacuum box 22. The vacuum box 22 is connected to a vacuum source as indicated by the symbol, V.

Fluid pressure within the first and second chambers 68 and 62 is higher than ambient pressure and this creates deflection forces tending to force the cap 46 upward, away from the moving substrate 42. The cap 46 is free to move upward relative to the enclosure 48, while each of the fluid seals 52 and 52' remain stationary between the cap 46 and one of the recessed grooves 78 and 78'. Because the cap 46 is fixed relative to the enclosure 48 only at its cross-machine direction ends, the cap 46 is free to bow away from the moving substrate 42 at a location between the cross-machine direction ends.

It should be noted that the pressure forces do not cause the enclosure 48 to move upward or bow away from the moving substrate 42. The reason for this is that the pressure forces acting on the horizontal projected areas 88 and 88' of non-vertical portions of the inside surfaces 70 and 70' are balanced against the pressure forces acting on the horizontal projected areas 92 and 92' of the non-vertical portions of the inside surfaces 90 and 90'. Another way of stating this is to say that the upward forces acting on the horizontal projected area 88 equals the downward forces acting on the horizontal projected area 92. The same holds true for the horizontal projected areas 88' and 92'.

It should be noted that the shape or configuration of the inside surfaces 70 and 70' as well as 92 and 92' is irrelevant.

The only thing that matters is that the sum of the pressure forces acting on the horizontal projected areas 88 and 88' of the enclosure 48 be equal to the sum of the pressure forces acting on the horizontal projected areas 92 and 92' of the cap 46. The net force acting on the projected areas, 88 and 92 and 88' and 92' respectively, will be zero. Consequently, the pressurized fluid within the first and second chambers, 68 and 62 respectively, does not generate an upward or downward force on the enclosure 48.

Still referring to FIG. 3, one will notice that the pair of cap seals 52 and 52' have a slight vertical offset. This is to emphasize the fact that the cap seals 52 and 52' are in direct slideable contact with the inside surfaces 90 and 90' of the cap 46. Each of the cap seals 52 and 52' can be a thin strip of metal having a thickness on the order of several thousands of an inch. The actual thickness of the cap seals 52 and 52' is not important.

Figure 5:
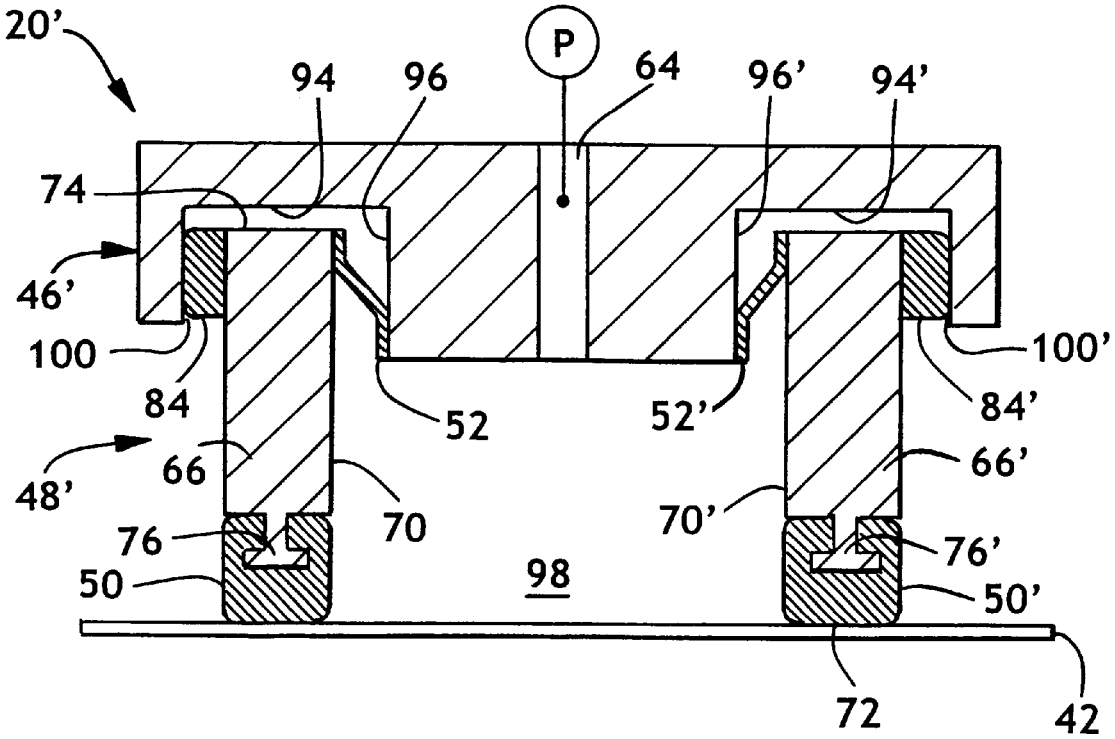
FIG. 5 is a across-sectional view of an alternative pressure chamber to that shown in FIG. 3.

Referring now to FIG. 5, an alternative design for a pressure chamber 20' is shown. The pressure chamber 20' includes a cap 46' and an enclosure 48'. The enclosure 48' is constructed from a pair of enclosure walls 66 and 66' defining inside surfaces, 70 and 70' respectively. The enclosure 48' has a first perimeter 72 that is in sealing contact with the moving substrate 42, and a second perimeter 74 that is in sealing contact with the cap 46'. The second perimeter 74 no longer contains the recessed grooves 78 and 78', shown in FIG. 3. Instead, a pair of cap seals 52 and 52' are fixedly attached to the inside surfaces, 70 and 70' respectively.

The walls 66 and 66' of the enclosure 48' have a pair of enclosure seals 50 and 50' joined thereto which seal the enclosure 48' to the moving substrate 42. The pair of enclosure seals 50 and 50' may each be slideably mounted on a pair of inverted T-shaped seal mounts 76 and 76' for ease of replacement. Each enclosure seal 50 and 50' is desirably shaped and formed in a manner that minimizes wear or other disruption of the moving substrate 42. The enclosure seals 50 and 50' can be formed of resilient plastic compounds, ceramic, coated metal substrates, or the like. The pair of seal mounts 76 and 76' may be formed from the same variety of materials as the enclosure seal 50 and 50'. Alternatively, the pair of seal mounts 76 and 76' may be formed from the same variety of materials as the enclosure 48'. Other means of sealing the enclosure 48' to the moving substrate 42 can also be used.

The cap 46' is constructed with a pair of recessed grooves 94 and 94' each having an inner surface, 96 and 96' respectively. Each recessed groove 94 and 94' is generally U-shaped, but could be V-shaped or some other suitable shape. The pair of walls 66 and 66' of the enclosure 48' partially resides within the recessed grooves 94 and 94'. During operation, a pressurized fluid is introduced into an enclosure chamber 98 though a port 64 located in the cap 46'. Alternatively, the pressurized fluid could be introduced to the enclosure chamber 98 through a port located in the enclosure 48'. The pressurized fluid is retained within the enclosure chamber 98 by the pair of cap seals 52 and 52', The cap seals 52 and 52' function between the surfaces 70 and 96, and 70' and 96' respectively, to prevent the escape of pressurized fluid from the chamber 98. The pair of inner surfaces 96 and 96' can slide axially relative to the pair of cap seals 52 and 52' attached to enclosure 48' without leakage of the pressurized fluid.

A pair of lateral support members 84 and 84' are attached to the pair of opposing walls 66 and 66', and they are in slideable contact with a pair of outer surfaces, 100 and 100' respectively, of the recess groves 94 and 94'. The lateral support members 84 and 84' can be formed of low friction wear resistant material such as brass, bronze, plastic, or the like. The lateral support members 84 and 84' function to stabilize axial movement of the cap 46', and they help eliminate binding between the cap 46' and the enclosure 48'.

During operation, the cap 46' is free to bow axially from the pressure fluid forces, but the pair of cap seals 52 and 52' prevent the pressurized fluid from exerting any axial deflection forces on the enclosure 48'. The seal created by the interaction of the enclosure seals 50 and 50' and the moving substrate 42 is not compromised or affected as pressurized fluid is introduced into the enclosure chamber 98.

If desired, the opposing inside surfaces 70 and 70' may be connected by bars, beams, rods or the like (not shown) for structural support. Such a construction would prevent the pair of opposing walls 66 and 66' from deflecting outward due to the pressurized fluid in the enclosure chamber 98. Spacing, location, and design of the bars could be determined by a structural analysis of the enclosure 48' at the maximum anticipated operating pressure.

While three embodiments of the present invention have been illustrated, other configurations for sealing the cap 46 or 46' to the enclosure 48 or 48' while permitting axial deflection of the cap 46 or 46' are possible. Alternatively, both the cap 46 or 46' and the enclosure 48 or 48' could include one or more recessed grooves intermeshed with opposing lands in the other member (not shown). Still alternatively, the cap 46 or 46' may reside completely within the enclosure 48 or 48', flush with the enclosure's second perimeter 74, and slideable sealed to the inside surfaces 70 and 70' of the enclosure 48 or 48'.

In each such design, any one of a number of ways can be employed to obtain a seal between the cap 46 or 46' and the enclosure 48 or 48'. Suitable seals can include a seal member disposed on, between or near the cap 46 or 46' and the enclosure 48 or 48'. Suitable materials for seals may include any fluid impermeable material, whether rigid or flexible, such as metals, polymers, plastics, foams, and rubber. Another possibility is a substantially fluid impermeable fit between the cap 46 or 46' and the enclosure 48 or 48'.

While the invention has been described in conjunction with two specific embodiments, it is to be understood that many alternatives, modifications and variations will be apparent to those skilled in the art in light of the aforegoing description. Accordingly, this invention is intended to embrace all such alternatives, modifications and variations that fall within the spirit and scope of the appended claims.

I claim:

1. An apparatus for maintaining a fluid seal with a moving substrate, said apparatus comprising:

a) an enclosure having a first surface and a second surface, said first surface being in sealing contact with said moving substrate;

b) a cap sealing off said second surface of said enclosure, said cap being secured to said enclosure at at least two spaced apart locations and said cap having a non-secured portion which is capable of deflecting independently of said enclosure; and c) means for introducing a pressurized fluid into said enclosure, said pressurized fluid creating a net force on said enclosure of zero and a force on said cap which causes a portion of said cap to deflect thus allowing said first surface of said enclosure to remain in sealing contact with said moving substrate.

2. The apparatus of claim 1 wherein said non-secured portion of said cap is sealed to said enclosure to prevent the escape of pressurized fluid.

3. The apparatus of claim 1 wherein said second surface of said enclosure has a recessed groove formed therein and said cap at least partially resides within said recessed groove.

4. The apparatus of claim 3 wherein said recessed groove contains a cap seal and a lateral support and said cap seal is in slideable contact with a surface of said cap.

5. The apparatus of claim 3 wherein said lateral support is positioned in said recessed groove opposite to said cap seal.

6. The apparatus of claim 1 wherein said enclosure forms a first chamber having a projected internal area and said cap has a vertically oriented wall which extends upward from said enclosure and forms a second chamber having a projected internal area.

7. The apparatus of claim 6 wherein said projected internal area of said first chamber is essentially equal to the projected internal area of said second chamber.

8. The apparatus of claim 1 wherein an enclosure seal is secured to said first surface of said enclosure and contacts said moving substrate.

9. The apparatus of claim 8 wherein said enclosure seal is ceramic.

10. An apparatus for maintaining a fluid seal with a moving substrate, said apparatus comprising:

a) an enclosure having a first surface and a second surface, said first surface being in sealing contact with said moving substrate;

b) a cap sealing off said second surface of said enclosure, said cap being secured to said enclosure at at least two spaced apart locations and said cap having a non-secured portion which is capable of deflecting independently of said enclosure; and c) means for introducing a pressurized fluid into said enclosure, said pressurized fluid creating a net force on said enclosure of zero and a force on said cap which causes a portion of said cap to deflect vertically relative to said enclosure thus allowing said first surface of said enclosure to remain in sealing contact with said moving substrate.

11. The apparatus of claim 10 wherein said second surface of said enclosure has a recessed groove formed therein and said cap at least partially resides within said recessed groove.

12. The apparatus of claim 11 wherein said recessed groove contains a cap seal and a lateral support for sealing said cap to said enclosure.

13. The apparatus of claim 12 wherein said cap seal is secured in said recessed groove and is in slideable contact with a surface of said cap.

14. The apparatus of claim 10 wherein said enclosure forms a first chamber having a projected internal area and said cap has a vertically oriented wall which extends upward from said enclosure and forms a second chamber having a projected internal area.

15. The apparatus of claim 14 wherein said projected internal area of said first chamber is essentially equal to said projected internal area of said second chamber.

16. An apparatus for maintaining a fluid seal with a moving substrate, said moving substrate containing water, said apparatus comprising:

a) an enclosure having a first surface and a second surface, said first surface being in sealing contact with said moving substrate;

b) a cap sealing off said second surface of said enclosure, said cap being secured to said enclosure at at least two spaced apart locations and said cap having a non-secured portion which is capable of deflecting independently of said enclosure; and c) means for introducing pressurized air into said enclosure, said pressurized air creating a net force on said enclosure of zero and a force on said cap, said upward force causing a portion of said cap to deflect relative to said enclosure thus allowing said first surface of said enclosure to remain in sealing contact with said moving substrate such that said pressurized air is forced through and removes at least a portion of said water from said moving substrate.

17. The apparatus of claim 16 wherein said second surface of said enclosure has a recessed groove formed therein and said cap at least partially resides within said recessed groove.

18. The apparatus of claim 16 wherein said enclosure forms a first chamber having a projected internal area and said cap has a vertically oriented wall which extends upward from said enclosure and forms a second chamber having a projected internal area, and said projected internal area of said first chamber is essentially equal to said projected internal area of said second chamber.

19. The apparatus of claim 16 wherein an enclosure seal is secured to said first surface of said enclosure and contacts said moving substrate.

20. The apparatus of claim 19 wherein said enclosure seal is ceramic.

* * * * *